US010881190B2

(12) United States Patent
Ortlieb

(10) Patent No.: US 10,881,190 B2
(45) Date of Patent: Jan. 5, 2021

(54) BACKPACK

(71) Applicant: Hartmut Ortlieb, Heilsbronn (DE)

(72) Inventor: Hartmut Ortlieb, Heilsbronn (DE)

(73) Assignee: ORTLIEB SPORTARTIKEL GMBH, Heilsbronn (DE)

( * ) Notice: Subject to any disclaimer, the term of this patent is extended or adjusted under 35 U.S.C. 154(b) by 18 days.

(21) Appl. No.: 16/335,426

(22) PCT Filed: Sep. 20, 2017

(86) PCT No.: PCT/DE2017/000311
§ 371 (c)(1),
(2) Date: Apr. 12, 2019

(87) PCT Pub. No.: WO2018/054407
PCT Pub. Date: Mar. 29, 2018

(65) Prior Publication Data

US 2020/0037734 A1 Feb. 6, 2020

(30) Foreign Application Priority Data

Sep. 21, 2016 (DE) ..... 20 2016 005 789 U
Dec. 14, 2016 (DE) ..... 20 2016 007 592 U
(Continued)

(51) Int. Cl.
*A45F 3/04* (2006.01)
*A45F 3/12* (2006.01)

(52) U.S. Cl.
CPC ..... *A45F 3/047* (2013.01); *A45F 3/12* (2013.01); *A45F 2003/045* (2013.01); *A45F 2003/122* (2013.01); *A45F 2003/127* (2013.01)

(58) Field of Classification Search
CPC ..... A45C 13/103; A45C 13/18; A45C 13/02; A45C 3/00; A45F 3/04; A45F 3/02;
(Continued)

(56) References Cited

U.S. PATENT DOCUMENTS 3,477,553 A * 11/1969 Kish, Jr. ..... A45C 5/02 190/119
4,411,344 A * 10/1983 Walker ..... A45C 5/14 190/18 A
(Continued)

FOREIGN PATENT DOCUMENTS

DE 20 2016 005 789 9/2016
DE 20 2016 007 592 12/2016
(Continued)

OTHER PUBLICATIONS

PCT/DE2017/000311, Written Opinion and International Search Report dated Feb. 1, 2018, 10 pages—English, 12 pages—German.

*Primary Examiner* — Adam J Waggenspack
(74) *Attorney, Agent, or Firm* — Nolte Lackenbach Siegel; Andrew F. Young

(57) ABSTRACT

The invention relates to a backpack or case, which, in the closed state, is formed or shaped from substantially an underside, upper side, lateral surfaces, a surface to be carried on the back and a front surface, wherein an opening region is formed on or along a surface (3) which is formed with at least one fold-down flap (13), whereby a substantially complete opening (2) of the substantially tub-shaped backpack body is made on the elongated surface to be carried on the back and on the at least one fold-down flap, by means of at least one zip closure (5), and wherein the surface to be carried on the back is provided with backpack straps.

8 Claims, 7 Drawing Sheets

(30) Foreign Application Priority Data

Dec. 14, 2016 (DE) ..... 20 2016 007 593 U
Dec. 14, 2016 (DE) ..... 20 2016 007 594 U

(58) Field of Classification Search
CPC ..... A45F 3/08; A45F 3/047; A45F 2003/045; Y10S 190/103
USPC ..... 224/607, 645, 657
See application file for complete search history.

(56) References Cited

U.S. PATENT DOCUMENTS 4,561,525 A * 12/1985 Shidner ..... A45C 3/00 190/106
6,382,377 B2 * 5/2002 Godshaw ..... A45C 13/02 190/109
6,651,853 B2 * 11/2003 Higgins ..... A45F 3/04 224/155
7,165,705 B2 * 1/2007 Haro ..... A45C 13/04 224/627
7,614,500 B2 * 11/2009 Chin ..... A45C 13/103 206/233
7,735,615 B2 * 6/2010 Looram ..... A45C 13/10 190/101
8,434,794 B2 * 5/2013 Sijmons ..... A45C 13/18 292/26
9,060,590 B2 * 6/2015 Valesko ..... A45F 3/08
2004/0134955 A1 * 7/2004 Williams ..... A45F 3/04 224/644
2005/0092802 A1 * 5/2005 Maley ..... A45F 3/08 224/628
2008/0245096 A1 10/2008 Hanson
2008/0314948 A1 * 12/2008 Cohen ..... A45C 13/103 224/645
2014/0231481 A1 * 8/2014 Tao ..... A45F 3/12 224/600
2017/0290400 A1 * 10/2017 Thomas ..... A45C 15/04

FOREIGN PATENT DOCUMENTS

DE 20 2016 007 593 12/2016
DE 20 2016 007 594 12/2016
FR 3008288 1/2015
JP 2006 326250 12/2006
JP 2006326250 A * 12/2006
WO WO 01/79069 10/2001
WO PCT/DE2017/000311 9/2017

* cited by examiner

BACKPACK

CROSS REFERENCE TO RELATED APPLICATIONS

This application relates to and claims the priority from Ser. No.: PCT/DE2017/000311 filed Sep. 20, 2017, which in turn claims priority from DE Ser. No.: 20 2016 005 789.9 filed Sep. 21, 2016, DE Ser. No.: 20 2016 007 592.7 filed Dec. 14, 2016, DE Ser. No.: 20 2016 007 593.5 filed Dec. 14, 2016, and DE Ser. No.: 20 2016 007 594.3 filed Dec. 14, 2016.

FIGURE SELECTED FOR PUBLICATION

FIGS. 6A, 6B, 6C, and 6D

BACKGROUND OF THE INVENTION

Field of the Invention

The present invention relates to a backpack or a case, in particular a backpack for carrying on the back with a corresponding back carrying system.

Description of the Related Art

Backpacks are known in many variations, embodiments and qualities for the most varied of applications. In addition to classic hiking backpacks, backpacks are now available for almost every type of sport, individually adapted to the requirements of the respective carrying group.

With respect to the openings of backpacks and their closing options, there are numerous different approaches, like roll closures, flaps with lanyards or straps, or also zip closures.

Like the classic backpack, almost all known backpacks are filled and or the contents of the backpack are accessed via an upper opening of a sack-shaped base body. In other variants, the backpack base body is designed as divided, and, for example, is accessible by unfolding or folding out into two separately accessible regions with a zip closure. By this means, an improved access into the respective regions of the backpack body is possible. Known backpacks are preferably equipped with backpack straps or a back carrying system consisting of carrying straps, a hip or abdominal belt and padding elements.

When carrying the backpack on the back of the wearer, the orientation of the opening region is usually oriented upward, or is laterally closable by an opening, which is accessible, e.g., using a zip closure.

On the one hand, the more or less accessible opening region of a backpack while wearing on the back is disadvantageous, as third parties may obtain, optionally, easy access to the contents, in that closures or zip closures may be opened, unnoticed by the wearer, and contents may be removed from the backpack. The relatively limited opening region, e.g. the upper opening of a sack-shaped base body is, as generally known, inconvenient during filling or emptying the backpack, and often the entire contents must be removed in order to arrive at certain packed items.*

ASPECTS AND SUMMARY OF THE INVENTION

It is therefore desirable and the object of the invention to create a backpack which is easy and comfortable to manipulate, both when using and in particular when accessing the contents, and in which an unnoticed access to the contents by third parties is prevented when carried on the back.

In particular, it is the object of the invention to create as large an access to the inner region of the backpack as possible, whereby filling and/or removing of individual objects or the entire contents is easily, quickly, and comfortably manageable.

This problem is solved by the features of the characterizing part of claim 1. Refinements and advantageous embodiments of the invention are included in the additional claims.

According to the invention a backpack or case, which, in the closed state, is formed or shaped substantially from an underside, upper side, lateral surfaces, a surface to be carried on the back, and a front surface, wherein an opening region is formed on or along a surface, preferably the surface to be carried on the back, which is formed with at least one fold-down flap, whereby a substantially complete opening of the substantially tub-shaped backpack body is formed on the elongated surface to be carried on the back and on the at least one fold-down flap, by means of at least one zip closure, and wherein the surface to be carried on the back is provided with backpack straps.

The zip closure thereby preferably runs along the center line of the rear surface and closes the outer peripheral opening of the backpack into a surface with preferably two substantially triangular projecting ends, which project upward and downward past the closed backpack body and are designed as fold-down flaps.

In the preferred embodiment, the outer periphery of the substantially tub-shaped backpack body is equipped with a zip closure separated in the center, wherein, upon closing the zip closure, a surface is produced on which approximately triangular flaps are formed, projecting in each case upward or downward past the base body. These are folded over as fold-down flaps and fixed on the base body of the backpack, whereby an approximately rectangular surface of the backpack is formed to be carried on the back. In an alternative embodiment, the backpack body is formed in a cut-based approach so that, after closing the zip closure, only one fold-down flap is produced, which is fixed on the base body and thus a surface to be carried on the back is formed.

The at least one fold-down flap is folded over in the direction of the backpack base body and tensioned on the same, for which purpose a ratchet closure or snap closure is used. Corresponding clamping or latching elements are thereby located in each case on the fold-down flap and on the base body of the backpack, and a clamping strap with latching or clamping means is correspondingly located at other, corresponding points.

The latching or clamping means of the ratchet and/or clamping closure is formed as biased with a spring on the clamping element side, whereby the clamping or latching between the corresponding elements may be carried out easily with one hand for releasing the connection.

In another variant according to the invention, the at least one fold-down flap is provided with a retaining, guiding, or connecting element for a strip-like tensioning means and a lashing, clamping, or releasing means, by means of which all fold-down flaps may be lashed down or tensioned, is arranged on the opposite front surface of the backpack body.

At the regions of the outer periphery of the backpack body, which form the surface to be carried on the back after closing the backpack, a back carrying system is preferably arranged or may be applied. This back carrying system is preferably arranged divided on the backpack body, symmetrical to the path of the zip closure. In alternative embodiments, this back carrying system, with various belts and/or padding, is removable as individual parts or as a whole or may be applied separately or as a whole. In the preferred embodiment, the backpack straps or shoulder straps and/or the hip belt are screwed on from the interior of the backpack, wherein preferably thread-cutting screws are used from the interior of the backpack and exterior, non-bulky plastic nuts are used.

Straps for pulling the backpack onto the back of the wearer are arranged on the shoulder straps in one preferred variant, and the position of the backpack straps on the backpack body may be mounted in variable positions, whereby fit adjustments to different anatomies of the wearers is facilitated.

Fixing means, by means of which the folded-down fold-down flap projecting above the base body may be applied onto the base body, are preferably arranged on the zip closure ends of the at least one fold-down flap. An adjustable ratchet closure is preferably arranged for this purpose. Alternatively, the fixing of the fold-down flap on the base body may be formed with at least one magnetic element or a hook and loop fastener such as those sold under the trademark Velcro ® or a surface covered with hook and loop elements such as those sold under the trademark Velcro®.

In the unfolded state, a substantially complete opening and thus access to the interior of the tub-shaped backpack body is possible. This is a decisive advantage in management over top loaders, in which a relative majority of the contents must be unpacked and repacked in order to arrive at certain contents. Such a perfectly accessible backpack may also always be loaded at an optimal or desired weight distribution through the virtually complete opening region.

The backpack is preferably equipped with two fold-down flaps, which in the closed state of the backpack project as respective triangular projecting ends upward and downward respectively past the surface to be carried on the back. The zipper tape halves of the opened zip closure, which may be equipped with one slider, however, is preferably equipped with two sliders, form the outer peripheral edge of the substantially tub-shaped backpack body in the open state of the backpack. In this open state, this backpack body may be ideally filled or individual objects may be comfortably located and removed through the virtually complete opening.

The backpack is preferably equipped in its interior with different reinforcements and/or reinforcing means, which are designed as rods or struts extending longitudinally, approximately parallel to the zip closure, and/or as intermeshing reinforcing elements extending transverse across the closed zip closure. The listed reinforcing rods, struts and intermeshing reinforcing elements are preferably arranged with and/or on flat, at least partially rigid plates, which are arranged, preferably welded, in the interior of the backpack in the region of the upper tub-shaped backpack body. The carrying elements, like the shoulder straps and hip belts, which are designed preferably as adjustable, are preferably fastened to these interior reinforcing plates.

Due to the longitudinal rods or struts extending approximately parallel to the zip closure, the backpack gains a longitudinal reinforcement of the back part in the closed state and a stabilization of the opening of the tub-shaped backpack body in the open state. This does not fall or fold together in an undesired way, caused by the reinforcing rods or struts, by which means a very comfortable access to the backpack interior is achieved. The backpack may be comfortably placed on the surface opposite the surface to be carried on the back and then opened: the opening is held open due to the stabilization rods or struts. By this means, the surface to be carried on the back is also protected from soiling during access to the contents, and thus the back of the wearer is safeguarded from soiling. The releasable intermeshing reinforcing elements, which extend transversely across the closed zip closure, and which are connected in a positive locking way when the zip closure is closed, impart a stabilization in the transverse direction to the backpack and in particular to the surface to be carried on the back. This is particularly advantageous for carrying the backpack on the back by means of the back carrying system or the belts, as a uniform load distribution is guaranteed and the backpack body is not strongly deformed.

The back carrying system itself is preferably arranged symmetrically divided along the zip closure line and thus of the opening. Also, a back padding consisting of multiple parts or back padding elements is/are arranged and/or formed as separately positionable to the right and left of the zip closure.

In the closed state of the zip closure, which preferably extends through the center line of the surface to be carried on the back, the backpack is stabilized by means of the separated back carrying system, and perfectly adaptable and carriable due to the releasable, intermeshing reinforcing elements extending transversely across the closed zip closure. The fold-down flaps, projecting upward and downward past the base body in the closed state of the zip closure, are folded onto the base body and are releasably fixed by means of fastening means applied at the ends of the zip closure and corresponding retaining elements on the base body. This connection is preferably designed as an adjustable ratchet closure, by means of which the fold-down flaps may be quickly, securely, and suitably laid on the base body and fastened. Alternatively, the fastening between the fastening means applied on the zip closure ends and the corresponding retaining elements on the base body may be designed as Velcro® connections, magnetic connections or cord connections.

The rear part of the backpack is preferably designed as concave in order to enable rear ventilation when wearing on the back. In another preferred embodiment, the rear part and/or the padding elements to the left and right next to the zip closure are respectively equipped with outwardly tensioned mesh or an air-permeable substrate.

The inner region of the backpack is preferably equipped with at least one transverse and/or longitudinal partition and/or tensioning device which is fixedly applied or removable. A tensioning device arranged in such a way in the inner region functions for simple compression and/or fixing of the contents in the interior of the backpack. The at least one partition creates a separate region in the interior of the backpack and may be designed purely as a partitioning wall or as an additional partitioning pocket, and may be equipped with a closure element like a zip closure or a Velcro® closure, and may also be completely removed from the inner region. The partition wall and/or inner pocket may be fixedly incorporated or removable in the interior of the backpack, for example, by means of a zip closure or Velcro® closure. The at least one partition or inner pocket, creating a region and attachable in the interior of the backpack may also be designed in another variant as an organizing system with different compartments. At least one avalanche buoyancy system may also be arranged in the interior of the backpack or may be attachable as an additional interior element. In one also preferred embodiment, these types of inner pockets are arranged next to the zipper tape and/or in the region of the zip closure, thus these inner pockets may also be very easily and simply reached by only a small or partial opening of the zip closure on the rear surface. It has additionally been shown that the embodiment of a zip closure on the rear surface with two sliders is advantageous, which enables a partial opening to the center of the rear surface, therefore, the access to the inner pockets in the region of the ends of the zip closure is particularly comfortable.

The backpack is a waterproof backpack in its preferred embodiment and is equipped with a waterproof and/or pressure-sealed zip closure. The fastening seams of the inner pockets and/or inner partitions are thereby preferably sealed by the welded zipper tapes.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
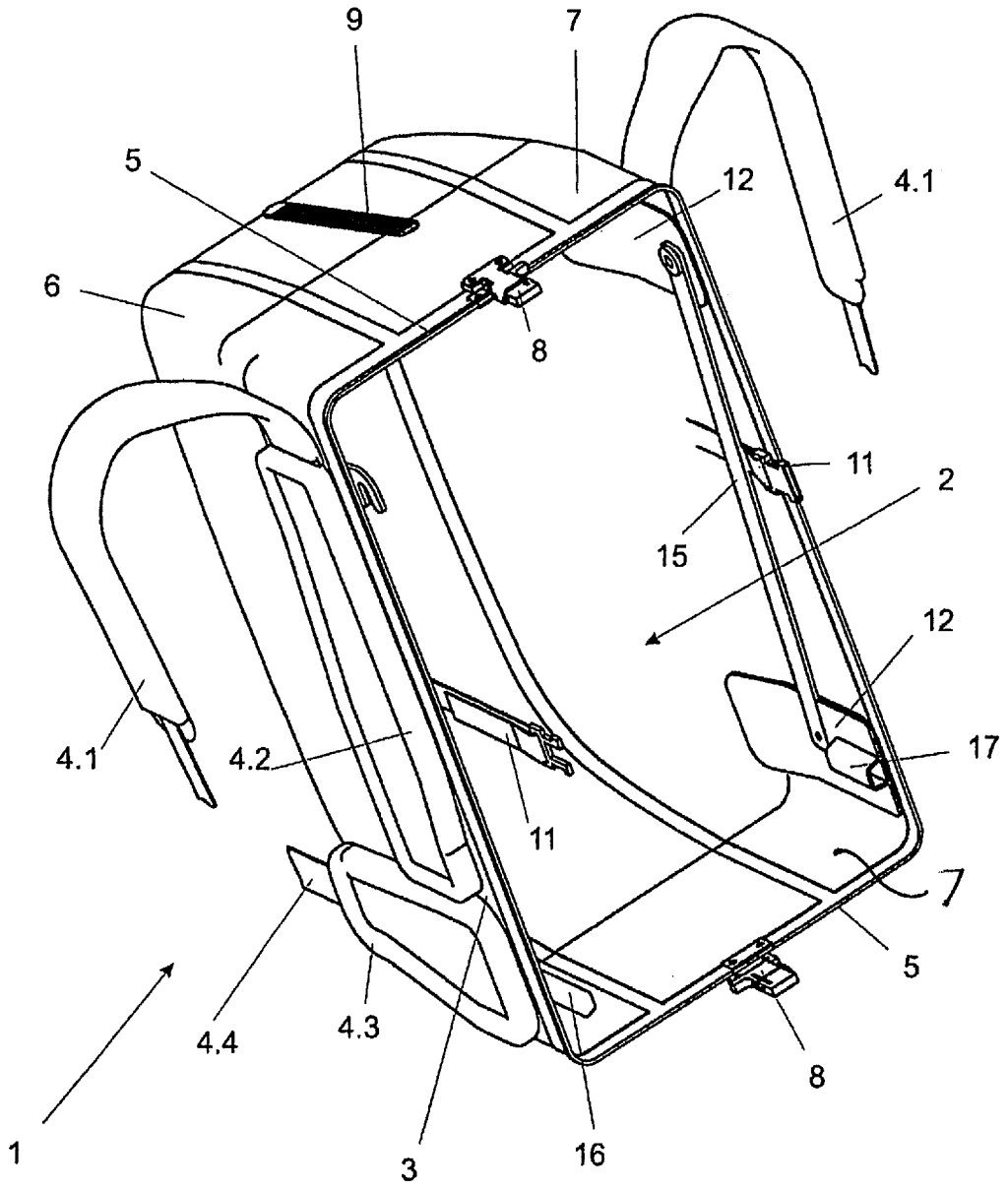
FIG. 1 shows a completely open backpack.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Figure 2:
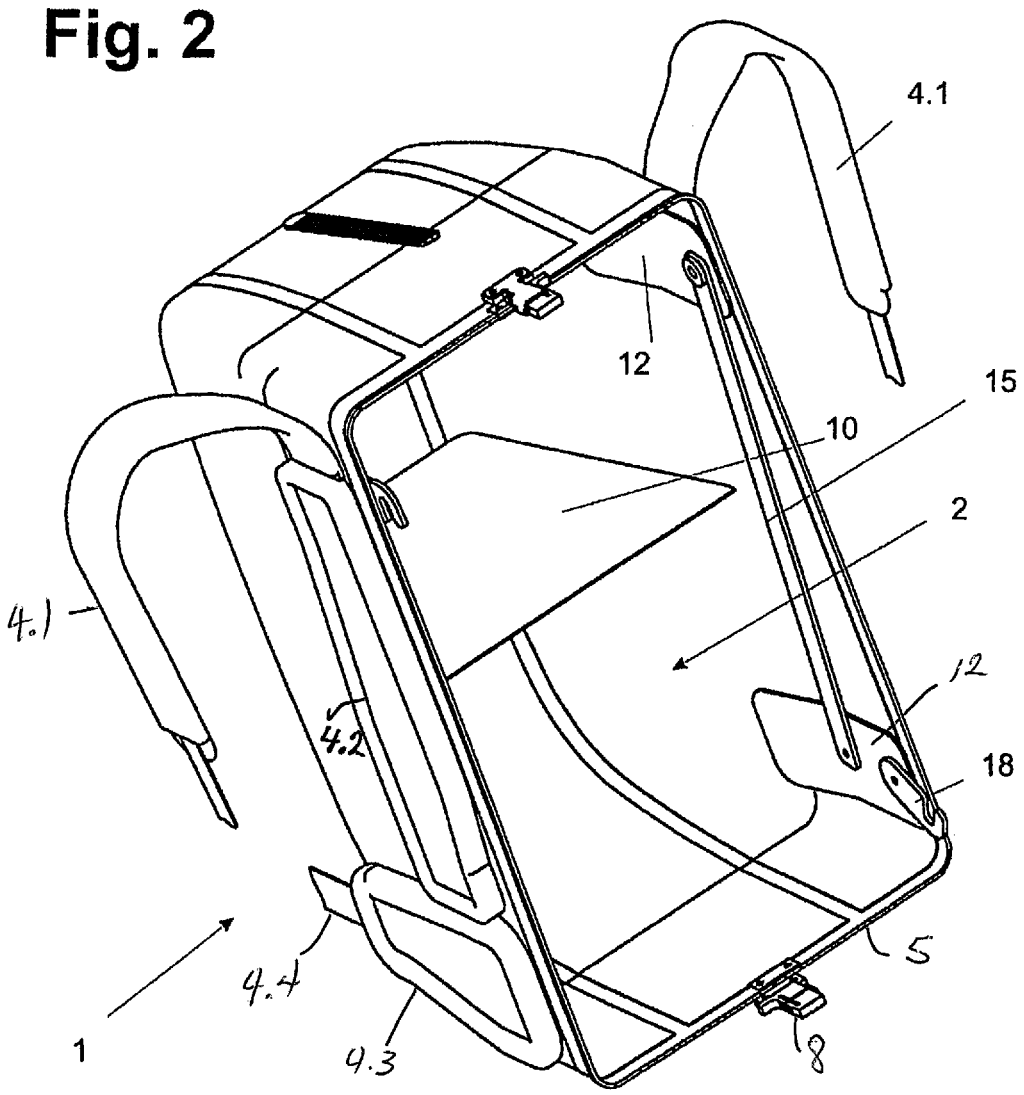
FIG. 2 shows a completely open backpack with a subregion.
Figure 3:
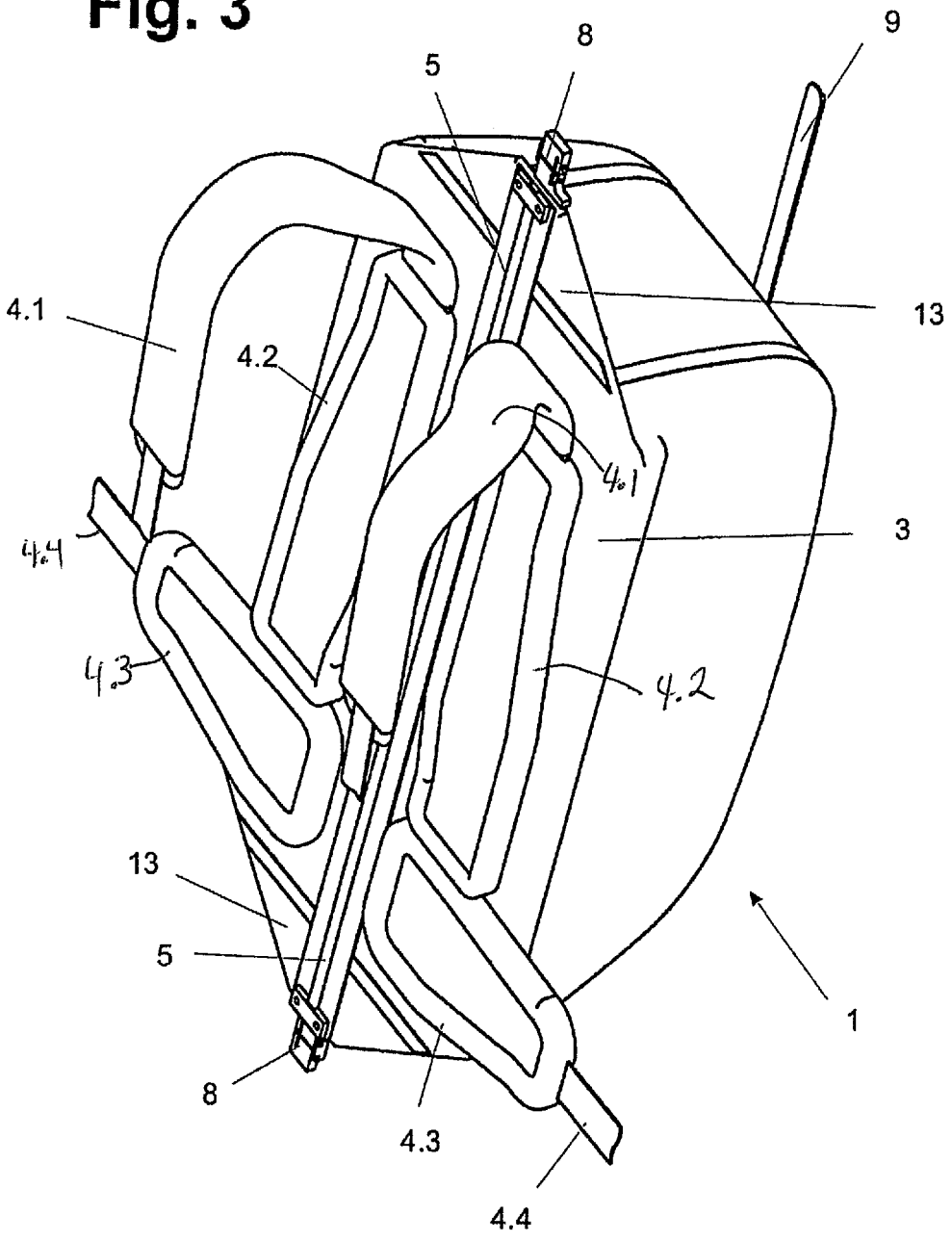
FIG. 3 shows a closed backpack with zip closure ends that still project.
Figure 4:
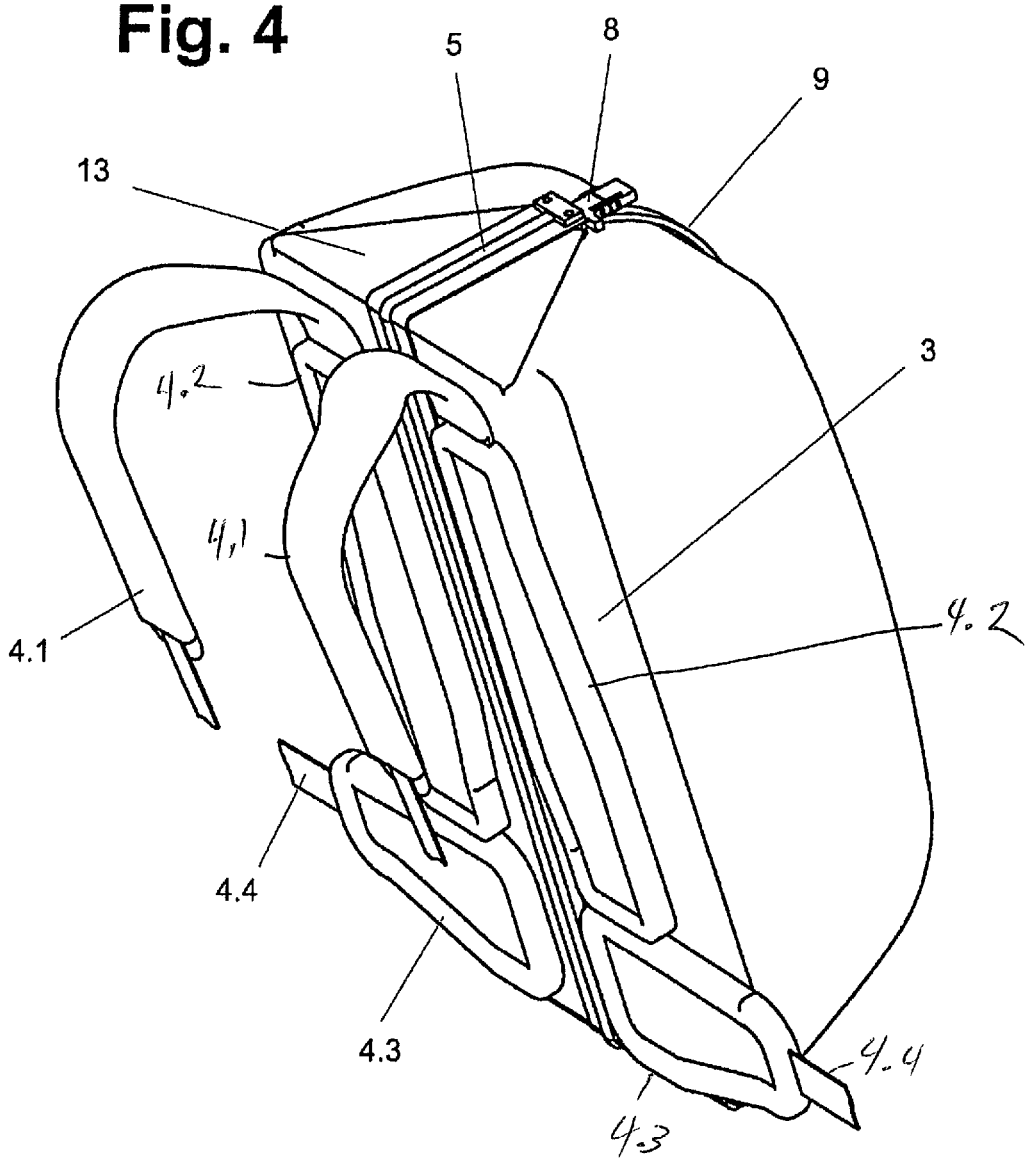
FIG. 4 shows a closed backpack with zip closure ends fastened on the base body.

FIG. 1 and FIG. 2 show a backpack 1 according to the invention in the open state, wherein the embodiment shown here is equipped on surface 3 to be carried on the back with a backpack strap system 4, comprising backpack straps 4.1, hip belt 4.4, and padding 4.2, 4.3, as is clear in FIG. 3. Surface 3 to be carried on the back is formed by means of folding projecting length 7 onto base body 6 during the closing of the backpack. In this embodiment, zip closure 5 extends in the center of elongated surface 3 to be carried on the back in the closed state of the backpack, as is shown in FIG. 3 and FIG. 4.

Backpack strap system 4, which comprises backpack straps 4.1, back padding 4.2, and also additional padding 4.3 and hip belt elements 4.4 is designed in this form in two parts and the corresponding halves are arranged to the right and left of zip closure 5.

As surface 3 to be carried on the back is formed from projecting length 7 extending tub-shaped base body 6, by corresponding folding or folding down of the projecting length or of at least one fold-down flap 13, surface 3 to be carried on the back is produced with substantially triangular fold-down flaps 13 with zip closure ends 8, projecting in each case upward and downward past the base body. Zip closure ends 8 are thereby equipped with retaining means, by means of which these are releasably fixed to corresponding fixing elements 9 on base body 6.

In one preferred embodiment, this connecting device is adjustable, e.g., by means of a ratchet strap, whereby the projecting triangular element may be well tensioned at the respective zip closure end. The fastening of the zip closure ends may likewise be solved with correspondingly placed Velcro® strips, Velcro® surfaces, magnetic elements or magnetic regions, or snap fasteners or simple cords.

Figure 7:
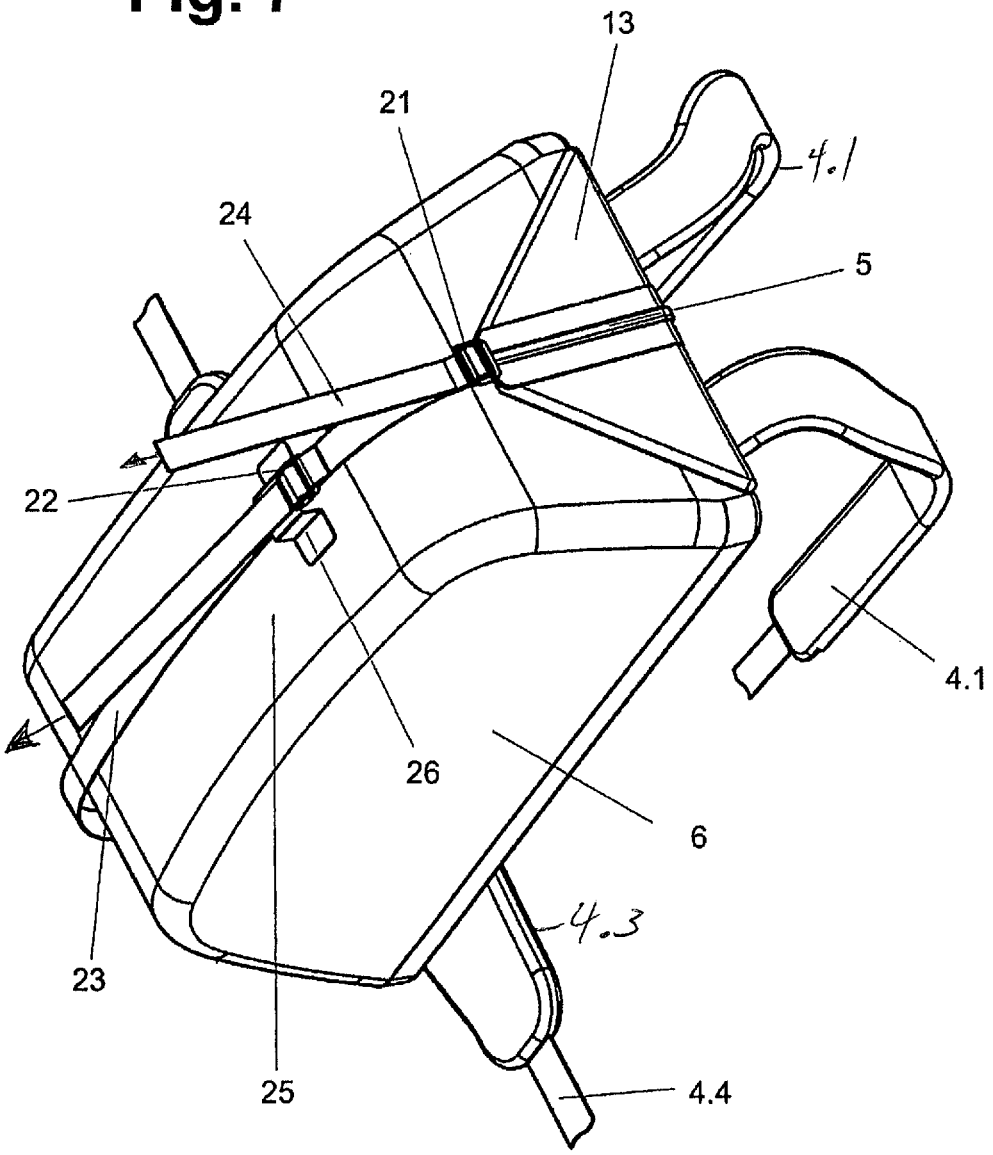
FIG. 7 shows a closed backpack with fold-down flaps tensioned on the backpack body which are manipulable from one side.

A preferred embodiment of a backpack is shown in FIG. 7, in which the manipulation or the loosening and tensioning of fold-down flaps 13 may be carried out from one side of the backpack. The at least one fold-down flap is thereby provided with a retaining, guiding, or connecting element 21 for a strip-like tensioning means 23. As shown here, a central lashing, clamping, or releasing means 22, which corresponds to the fold-down flaps via, for example, bands, belts, cords 23, 24 and via which the fold-down flaps are tensioned and applied to the front surface of the backpack, is arranged approximately in the center of front surface 25 of the backpack. Lashing, clamping, or releasing means 22 is locked on a stop 26 and retaining, guiding, or connecting element 21 is thereby formed on upper fold-down flap 13 as a clamping and releasing means.

By this means, the upper fold-down flap may be separately released and the backpack may be quickly opened in the upper region without having to lay out the backpack flat like a suitcase, as the lower fold-down flap remains tensioned. By this means, the backpack may be quickly packed and unloaded in the upper region.

Lashing, clamping, or releasing means 22, centrally arranged in the center of front surface 25, may be varied in its position; however, it is positioned in such a way that it is arranged in the center or closer to the upper side of the backpack, thus closer to fold-down flap 13 shown in FIG. 7.

The backpack may thus be selectively completely opened or only opened from the top while standing or hanging from its upper side, without having to reach around to the underside; if the backpack is to be completely opened, the backpack only needs to be folded over or unfolded after releasing the straps.

The two fold-down flaps are tensioned and applied to the backpack body at said central lashing, clamping, or releasing means 22 by means of tensioning elements, like belt straps 23, 24 shown. Due to the possibility for releasing the two fold-down flaps simultaneously at central lashing, clamping, or releasing means 22, the two fold-down flaps may be released when the backpack stands on its lower side, and the backpack may then be laid on front surface 25, whereby the large opening region on the surface to be carried on the back is accessible. This embodiment prevents having to lay the backpack on the surface to be carried on the back in order to operate the opening elements and to open the backpack, and thus also soiling this surface by laying it on the ground or another object. Thus, the soiling of the clothing of the wearer, who carriers the backpack on their back, is also effectively prevented.

Lashing device 22 made from lashing, clamping, or releasing means, is, as described, arranged in the upper region of the front surface of the backpack, when removed from the back and set up, and is connected to the ends of fold-down flaps 13 by means of, for example, belt straps 23, 24 as shown and at least two connecting elements 21. The connecting elements may be equipped with click closures for quick release, and the belt straps are guided around the front surface of the backpack. In a variant that is not depicted, guides or guide pockets for the belt straps are arranged on the front surface, which improves the visual effect and supports a positioning of the belts. The lashing device also has a stop for at least one belt strap at least one fold-down flap, so that said strap is not accidentally unthreaded.

In another preferred embodiment, the zip closure ends or the projecting triangular elements and a region on the base body are equipped with magnetic elements, whereby the projecting triangular projecting end may be simply brushed across the base body after folding to close the backpack, and where the projecting end is fastened on the same by the corresponding magnetic region.

Zip closure 5 is preferably equipped with two sliders, whereby the potential is created to only open a smaller region of the backpack. The inner region is hereby, as is clear in FIG. 2, equipped with one or more partitions 10, to which very easy and fast access is obtained by opening the zip closure using the upper slider. Partitions 10 are thereby preferably designed as adjustable and/or removable and insertable at different points, and may be applied by means of Velcro® connections, push-buttons or a correspondingly provided zip closure.

In another variant, one or more partitions may also be arranged longitudinally in the inner region, whereby a longer or larger separated pocket is created in the interior.

For simple and better compression and securing the contents in the backpack interior, at least one tensioning device 11, as shown in FIG. 1, is provided in the interior, by means of which the contents are fixed and compressed. By this means, the contents are secured against falling out too easily and they are compressed, which contributes to significant ease when closing the backpack and the zip closure.

As is shown in FIG. 1 and FIG. 2, the backpack is equipped in one preferred embodiment with at least one, inner reinforcing means, designed as reinforcing plate 12, which, in the combination shown of longitudinally arranged rod-shaped element 15 extending substantially parallel to the zip closure belt and reinforcing plate 12, contributes to a support of the open position of the backpack.

Additional reinforcing elements 16, 17 (as seen in FIG. 1) or latching lugs 18 (as seen in FIG. 2), which extend transversely across closed zip closure 5 and engage into each other in a positive locking way during closing, stabilize the backpack and in particular the position at the hips. The two portions of the hip belt 4.4 are thereby fixed on respective reinforcing plates 12, 12, on which intermeshing respective reinforcing elements 16, 17 18 are arranged, whereby the backpack may deform less and offers good wearing comfort.

Figure 5:
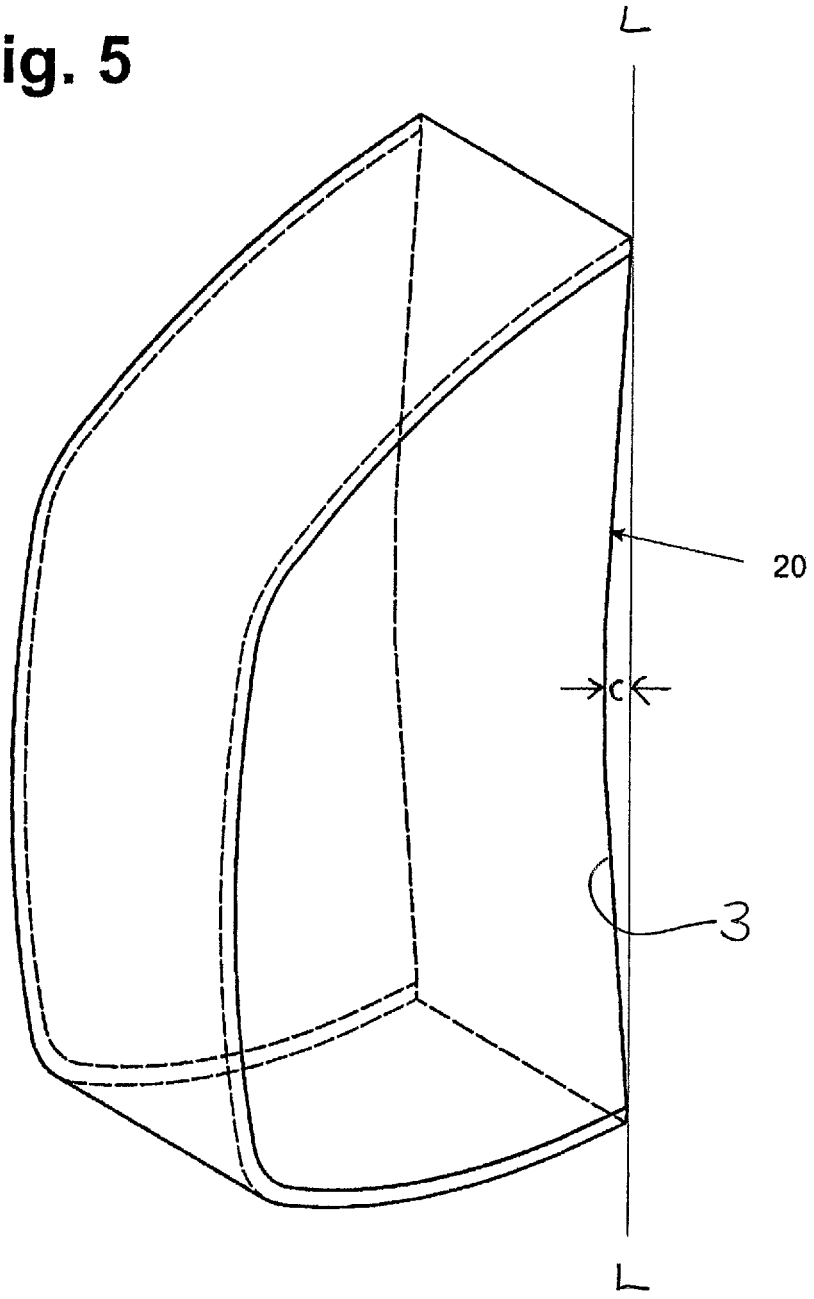
FIG. 5 shows a tub-shaped base body or welded body.
Figure 6A:
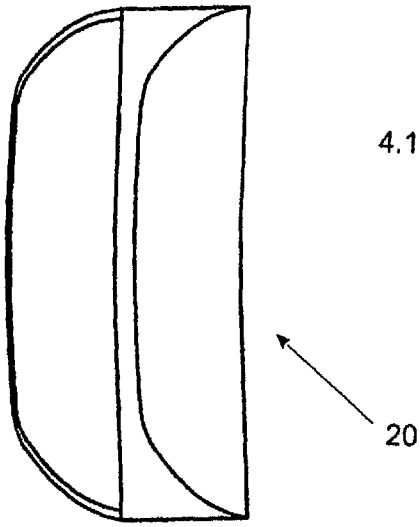
FIGS. 6A, 6B, 6C, and 6D show an overview of different physical states of the backpack according to the invention.
Figure 6B:
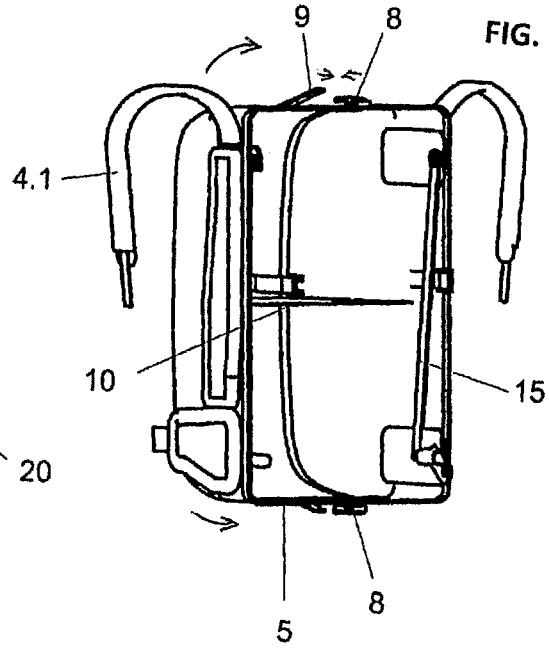
Figure 6C:
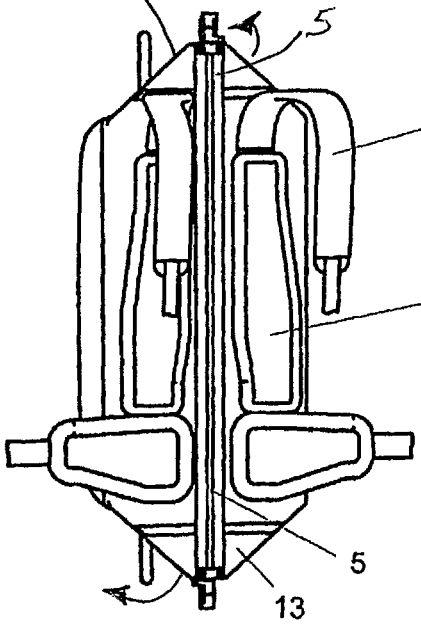
Figure 6D:
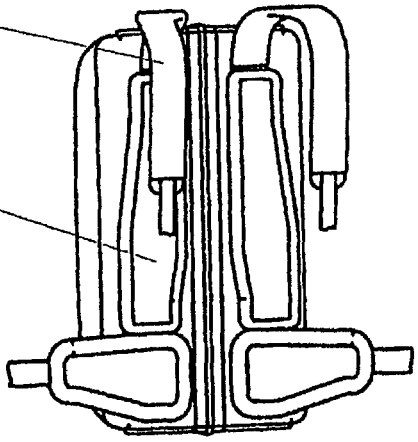

In the upper left in FIG. 5 and FIG. 6A, a base body 20 of the backpack or backpack body is shown, which forms a tub-shaped body by its closed surfaces. In this open state, the tub-shaped body is equipped on its outer periphery with a zip closure 5, as is depicted in the upper right in FIG. 6B, wherein ends 8 of the zip closure each lie in the center of the short side. By bending upper region 7 of base body 6 and closing zip closure 5, the closed backpack is obtained according to FIG. 3 and the lower left of FIG. 6C, with a surface 3 to be carried on the back and fold-down flaps 13. Fold-down flaps 13 projecting upward and downward past base body 6 are bent against the base body by folding, whereby a planar, slightly concave flat configuration showing a concave distance C relative to a respective flat line L, as in FIGS. 5 and 6D for carrying on the back is created.

The fold-down flaps are releasably fixed in this position with the fastening elements, preferably, for example, an adjustable ratchet or clamping strap closure.

After the preferred embodiments of the invention have been described with reference to the accompanying figures, it is maintained that the invention is not limited to these exact embodiments, and that different changes and modifications may be carried out by a person skilled in the art without deviating from the scope of the invention, as it is defined in the accompanying claims.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. A backpack, which in the closed state, comprises:

an under side, an upper side, a plurality of lateral surfaces, an elongate surface to be carried on the back and a front surface; and said backpack, including:

a tub-shaped backpack body;

an opening region formed on a surface which is formed with at least one fold-down flap;

whereby a complete opening of said opening region of the tub-shaped backpack body is made on the elongated surface to be carried on the back and on the at least one fold-down flap by means of a zip closure having opposed zipper closure ends, and wherein the surface to be carried on the back is provided with a backpack carrying system with respective pairs of backpack straps hip belts with pairs of hip belt padding and pairs of back paddings spacing respective backpack straps and respective hip belts;

respective ones of said pair of backpack straps, said pair of hip belts, said pair of hip belt paddings, and said pair of back paddings fixed on separate opposed sides of said elongate surface to be carried on the back and formed on opposing sides of said opening region of said tub-shaped backpack body and forming said backpack carrying system in said closed state;

said at least one fold-down flap having at one of said opposed zipper closure ends of said zip closure and covering a portion of one of said plurality of lateral surfaces in said closed state;

the elongate surface to be carried on the back in said closed state has a concave shape in the closed state;

wherein said zip closure is one of a waterproof zip closure or a pressure-sealed zip closure;

wherein each opposed upper region of the tub-shaped base body is directed toward the opening region and further comprises:

opposed pairs of rigid reinforcing means fixed on an inner side of said tub-shaped backpack body proximate said zipper closure;

opposed pairs of engaging reinforcing elements are arranged on respective rigid reinforcing means and engage into each other in a positive locking way when said backpack is in said closed state;

opposed pairs of rod-shaped elements join and space respective pairs of said rigid reinforcing means, and each rod-shaped element extends parallel to the zip closure on either inner side of said opening region; and an inner tension device spaced on opposed inner sides of said opening region proximate said zip closure and engaging in tension when said backpack is in said closed state; and each said hip belt is fixed to said respective reinforcing means.

2. The backpack, according to claim 1, wherein:

wherein the ends of the zip closure substantially extend along said opening region and form said at least one fold-down flap and an opposed-side fold-down flap wherein the fold-down flaps project past the base body in said closed state.

3. The backpack, according to claim 1, wherein:

the zip closure ends are at projecting ends of respective fold-down flaps and are releasably affixed to respective pairs of fixing elements on said base body.

4. The backpack, according to claim 3, wherein:

the corresponding fastening means on the zip closure ends and the retaining elements on the base body are designed as at least one of a group of closures consisting of adjustable ratchet closures, hook and loop connections, magnetic connections, and cord connections.

5. The backpack, according to claim 1, further comprising:

at least one of a plurality of inner pockets arranged in an inner region of the backpack next to the zip closure.

6. The backpack, according to claim 5, wherein:

a fastening seam of the inner pockets is sealed by welded zipper tapes.

7. The backpack, according to claim 5, wherein:

the inner pockets are arranged proximate at least one of said zip closure ends and said flap ends.

8. The backpack, according to claim 1, further comprising:

at least one partition is formed in the interior of the backpack.

* * * * *